343-700 MS AU 251 EX
9/23/86 OR 4,613,868

United States Patent [19]

Weiss

[11] Patent Number: 4,613,868

[45] Date of Patent: Sep. 23, 1986

[54] METHOD AND APPARATUS FOR MATCHED IMPEDANCE FEEDING OF MICROSTRIP-TYPE RADIO FREQUENCY ANTENNA STRUCTURE

[75] Inventor: Michael A. Weiss, Nederland, Colo.

[73] Assignee: Ball Corporation, Muncie, Ind.

[21] Appl. No.: 463,588

[22] Filed: Feb. 3, 1983

[51] Int. Cl.[4] ..... H01Q 1/38

[52] U.S. Cl. ..... 343/700 MS; 343/767

[58] Field of Search ..... 343/700 MS, 767, 746, 343/860–862

[56] References Cited

U.S. PATENT DOCUMENTS

| | | | |
|---|---|---|---|
| Re. 29,296 | 7/1977 | Krutsinger et al. | 343/700 MS |
| Re. 29,911 | 4/1979 | Munson | 343/700 MS |
| 2,895,133 | 7/1959 | Choquer et al. | 343/767 |
| 3,713,162 | 1/1973 | Munson et al. | 343/705 |
| 3,778,717 | 12/1973 | Okoshi et al. | 343/767 |
| 3,810,183 | 5/1974 | Krutsinger et al. | 343/708 |
| 3,811,128 | 5/1974 | Munson | 343/787 |
| 3,921,177 | 11/1975 | Munson | 343/846 |
| 3,938,161 | 2/1976 | Sanford | 343/829 |
| 3,971,032 | 7/1976 | Munson et al. | 343/700 MS |
| 4,012,741 | 3/1977 | Johnson | 343/700 MS |
| 4,051,477 | 9/1977 | Murphy et al. | 343/700 MS |
| 4,069,483 | 1/1978 | Kaloi | 343/700 MS |
| 4,070,676 | 1/1978 | Sanford | 343/700 MS |
| 4,125,839 | 11/1978 | Kaloi | 343/700 MS |
| 4,138,684 | 5/1979 | Kerr | 343/846 |
| 4,151,531 | 4/1979 | Kaloi | 343/700 MS |
| 4,157,548 | 6/1979 | Kaloi | 343/700 MS |
| 4,180,817 | 12/1979 | Sanford | 343/700 MS |
| 4,191,959 | 2/1980 | Kerr | 343/700 MS |
| 4,426,649 | 1/1984 | Dubost et al. | 343/700 MS |
| 4,443,802 | 4/1984 | Mayes | 343/767 |

FOREIGN PATENT DOCUMENTS

| | | |
|---|---|---|
| 2408578 | 8/1975 | Fed. Rep. of Germany . |
| 2311422 | 12/1976 | France . |
| 2074792 | 11/1981 | United Kingdom . |
| 2101410 | 1/1983 | United Kingdom . |

*Primary Examiner*—Eli Lieberman

*Attorney, Agent, or Firm*—Gilbert E. Alberding

[57] ABSTRACT

The center region of a dual slot microstrip-type antenna radiator "patch" structure is forced to take on a controlled non-zero radio frequency impedance by the provision of a slot formed therein at the center region. By controlling the dimension of such an impedance-matching slot in the radiator patch, a feedpoint connection may be made at the center region of the radiator patch and still achieve matched impedance feed. Because the feedpoint can thus be centrally located within the antenna structure, any spurious radiation which occurs from the feedpoint connection or associated feedlines does not tend to skew the overall or composite radiation antenna of the pattern as much as when such feedpoints are asymmetrically disposed on the radiator patch with respect to the primary radiating apertures.

11 Claims, 4 Drawing Figures

FIG. 1
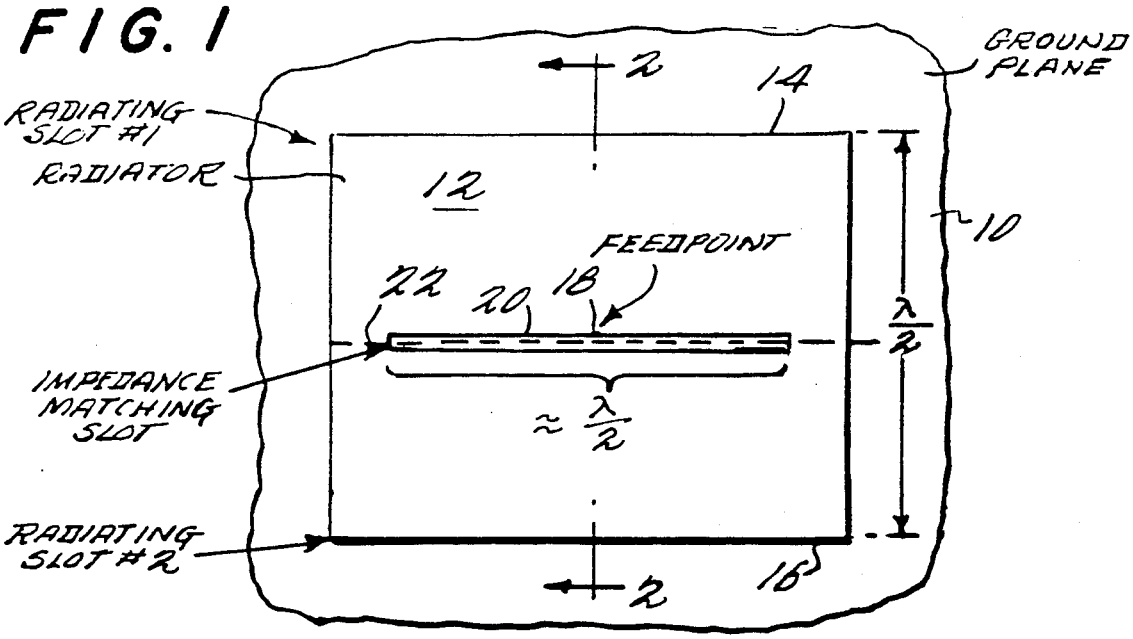
FIG. 2
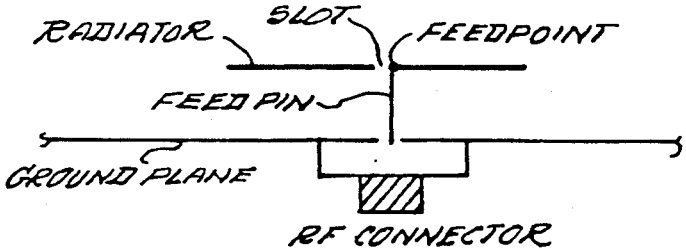
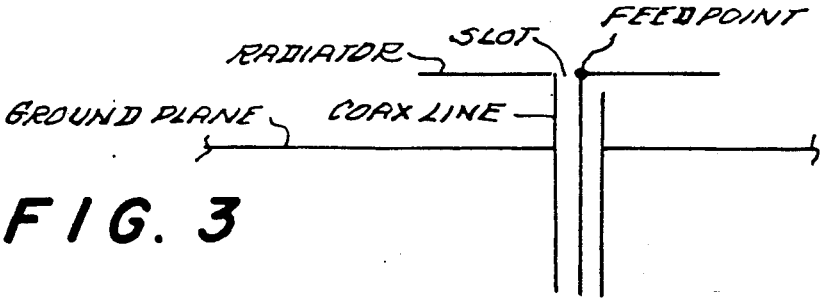
FIG. 3
FIG. 4
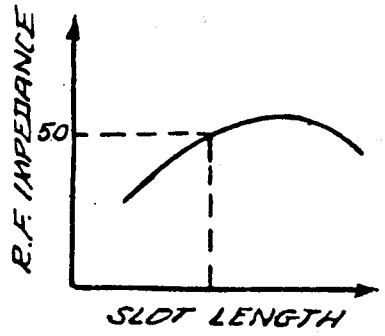

METHOD AND APPARATUS FOR MATCHED IMPEDANCE FEEDING OF MICROSTRIP-TYPE RADIO FREQUENCY ANTENNA STRUCTURE

This invention is generally directed to method and apparatus for achieving matched impedance feeding of microstrip-type antenna structures and/or for minimizing the asymmetric effects on the overall radiation pattern of such a structure caused by spurious radiation from the feedpoint connection or feedlines associated therewith.

In the context of this application, a microstrip-type antenna is one that is generally well known in the prior art as comprising a conductive ground or reference surface over which a resonantly dimensioned conductive radiator "patch" is disposed at a distance which is typically substantially less than one-tenth wavelength at an intended antenna operating frequency. The volume defined or delimited between the shaped conductive radiator patch and the underlying reference surface provides a resonant cavity with one or more radiating apertures defined by one or more corresponding edges of the conductive patch and the underlying ground plane.

This invention is particularly adapted for use with a "dual slot" type of such microstrip structure typically having a one-half wavelength resonant dimension (as measured in the dielectric spacing medium) with a pair of transverse radiating slots formed by opposing parallel edges of a generally rectangularly shaped radiating patch. As will be appreciated by those in the art, the radio frequency impedance of such a dual slotted radiating structure is typically at a maximum along the open circuited edges of the patch which define the radiating apertures and at a minimum (e.g. substantially zero) along the center line of the patch. Accordingly, in the prior art it has typically been the practice to achieve matched impedance at a feedpoint by choosing the feedpoint at some location within the conductive patch structure where the r.f. impedance is substantially equal to that of the feed structure to be connected. Since such feed structures typically have a characteristic impedance of approximately 50 ohms or so, this has generally meant that such patches are fed at a point relatively close to one of the edges which also define one of the radiating apertures. If integrally constructed microstrip feedline is used for the feeding structure, such an internal feedpoint is typically reached by forming an indentation or slot in the edge of the conductive patch so as to permit the feedline to be connected to the desired matched impedance point.

There are a number of issued U.S. patents commonly assigned with this application and generally directed to microstrip antenna structures of various types. A partial listing follows:

| | | |
|---|---|---|
| U.S. Pat. No. 3,713,152 | Munson et al | (1973) |
| U.S. Pat. No. 3,810,183 | Krutsinger et al | (1974) |
| U.S. Pat. No. 3,811,128 | Munson | (1974) |
| U.S. Pat. No. 3,921,177 | Munson | (1975) |
| U.S. Pat. No. 3,938,161 | Sanford | (1976) |
| U.S. Pat. No. 3,971,032 | Munson et al | (1976) |
| U.S. Pat. No. Re.29,296 | Krutsinger et al | (1977) |
| U.S. Pat. No. 4,012,741 | Johnson | (1977) |
| U.S. Pat. No. 4,051,477 | Murphy et al | (1977) |
| U.S. Pat. No. 4,070,676 | Sanford | (1978) |
| U.S. Pat. No. Re.29,911 | Munson | (1979) |

-continued

| | | |
|---|---|---|
| U.S. Pat. No. 4,180,817 | Sanford | (1979) |

There are also other issued U.S. patents which relate to microstrip antenna structures. For example:

U.S. Pat. No. 4,125,839—Kaloi (1978)

U.S. Pat. No. 4,151,531—Kaloi (1979)

U.S. Pat. No. 4,157,548—Kaloi (1979).

The above listed Kaloi patents are specifically directed, in at least some respects, to feeding structures for microstrip antennas. It is noted that such feeding structures are typically asymmetric as are those in the earlier cited issued U.S. patents.

It is presently believed that, in spite of efforts to prevent it, spurious radiation often occurs from the feeding points or connections in such microstrip antenna structures. This is especially so where a solder-connected "probe" feedpoint may itself act as a small monopole type of radiator. For some applications, the amount of such spurious radiation can become significant. Furthermore, because such feedpoints are typically located at some point on the radiator patch which is asymmetric with respect to the other sources of desired radiation, such spurious radiation may tend to skew the overall radiation pattern of the entire composite structure. Such skewing of the radiation pattern may itself be a serious detriment for certain antenna applications as will be appreciated by those in the art.

Once the possible impact of such spurious radiation from asymmetrically located feedpoints is recognized, it will be appreciated that these adverse effects might be minimized if the feedpoint was moved to a symmetric location on the radiator patch. However, since the feedpoint must as a practical matter be located at a place which has a matched r.f. impedance with the connected feedline structure, it has heretofore not been possible to choose a symmetric location of the feedpoint with complete freedom. For example, a typical dual slot microstrip antenna has a patch with a one-half wavelength resonant dimension transverse to the opposing edges which define the radiating apertures. Since the radiating apertures are by definition at a maximum r.f. impedance, it follows that the r.f. impedance at the center line of such a dual slotted radiator structure will be at a minimum (often substantially zero). Since feedline structures have substantial r.f. impedances (e.g. typically 50 ohms or so), the location of a feedpoint connection substantially at a symmetric center location on such a dual slotted microstrip radiator patch has not been heretofore possible.

Now, however, it has been discovered that such a dual slotted microstrip radiator patch may indeed be fed symmetrically essentially at its geometric center while at the same time permitting a matched r.f. impedance coupling at that point to a feedline structure having substantial impedance. This location of a matched r.f. impedance feedpoint is made possible by the provision of a narrow impedance matching slot formed substantially adjacent the feedpoint within the conductive patch and having a length dimension controlled so as to achieve the desired r.f. impedance matching.

Stated somewhat differently, although feeding a dual slotted microstrip antenna radiator patch at its center where the nominal r.f. impedance is essentially zero might be thought impossible or at least not feasible, it has now been discovered that it can indeed be made possible by providing an impedance matching slot near the center of the patch structure so as to force the r.f. impedance of the radiator at such a center feedpoint to be substantially matched to the feedline impedance (e.g. 50 ohms). The width of such an impedance matching slot is preferably small (e.g. on the order of 0.01 to 0.03 inch or so although this dimension is by itself not considered critical) while the length of the slot will determine the effective feedpoint r.f. impedance.

The impedance of a slot is known to be a function of both slot width and length (e.g. the slot perimeter); however for relatively narrow slots it is primarily a function of length. Typically the slot impedance increases with increasing length and then decreases to define a peaked impedance versus length curve. The slot impedance is also a function of distance above a ground plane with decreasing slot impedance as it is disposed closer to the ground plane.

That is, for example, in the exemplary embodiment the longer such a slot is made (so long as it is somewhat less than one-half wavelength long) the higher the r.f. impedance at the center-located feedpoint. Thus, this invention provides method and apparatus for feeding a microstrip radiator at a location which is symmetrically positioned with respect to the primary radiation apertures of that structure (e.g. essentially at the center of a dual slot half wavelength radiator patch) while at the same time permitting a matched impedance coupling at that point to a desired feedline structure. The net result is an overall composite radiation pattern of the structure which tends to be less skewed by spurious radiation emanating from the feedpoint location or associated feedline structure itself. It also provides a very simple and uncomplicated technique for achieving matched r.f. impedance feedpoints at virtually any desired location on the radiator patch structure.

Although some other quite different types of antenna structures in the prior art have utilized slots of various configurations for various purposes including impedance matching purposes (e.g. see U.S. Pat. No. 2,895,133—Choquer et al—1959—directed to a wide band cylindrical dipole structure), this invention is believed to be the first discovery that an impedance matching slot can be used to force a matched r.f. impedance feedpoint at a desired symmetric location on a microstrip antenna structure.

These as well as other features and objects of this invention will become better understood by careful reading of the following detailed description of the presently preferred exemplary embodiments of this invention taken in conjunction with the accompanying drawings, of which:

FIG. 1 is a plan view of a dual slotted microstrip antenna structure having an impedance matching slot and centrally located feedpoints in accordance with this invention;

FIG. 2 is a sectional view of the structure shown in FIG. 1 illustrating an exemplary probe fed embodiment thereof;

FIG. 3 is a side view of the apparatus shown in FIG. 1 illustrating an exemplary coaxial cable feed arrangement; and FIG. 4 is an exemplary graph of r.f. slot impedance versus frequency.

As previously explained, a typical dual slotted microstrip antenna structure includes a conductive ground or reference surface 10 and a shaped conductive radiator patch 12 disposed thereabove. The conductive patch 12 typically has a one-half wavelength resonant dimension as indicated in FIG. 1 so as to define a resonant cavity in the volume between patch 12 and the underlying ground plane delimited by the edges of the patch 12. A pair of radiating slots are also defined by opposing edges 14, 16 of the patch and the underlying ground plane 10. The transverse dimension of the radiator patch 12 is typically somewhere between one-half (it may also be smaller than this) and one wavelength. If the transverse dimension is on the order of one wavelength or larger than this, then multiple feedpoints are preferably utilized along the extended length of the structure to maintain uniform fields along the transverse dimension. The transverse dimensions of the radiator structure are typically related to the relative magnitude or quantity of radiation which can be expected to emanate from or to the pair of radiating apertures.

As also earlier mentioned, the radiator patch 12 is typically disposed only a relatively short distance above the ground plane (e.g. typically considerably less than one-tenth wavelength). However, since a microstrip radiator structure of this type has an effective operating frequency bandwidth which increases for increasing element-to-ground plane spacings, where relatively wider operating frequency bandwidths are required, the radiator patch 12 is typically disposed at a somewhat greater than usual distance from the ground plane 10 (albeit still probably less than about a tenth of a wavelength in normal practice). On the other hand, the effective maximum r.f. impedance along edges 14 and 16 of the radiator patch 12 decreases as the element-to-ground plane spacing is increased. Thus, for some applications, using prior art techniques, it may be necessary to place a feedpoint 10 or the like structure at or beyond the edge of the radiator patch 12. Furthermore, such an asymmetric location of the feed pin which itself acts as a top-loaded monopole radiator, has the effect of skewing the overall or composite radiation pattern of the radiating slots and feed pin.

Now, however, in accordance with this invention, the feedpoint connection 18 is symmetrically located substantially at the center of the radiator patch 12 (which is normally a zero r.f. impedance point). By such symmetrical location of the feedpoint, the adverse skewing effects on the overall composite radiation pattern of the entire structure are minimized even if the feed pin continues to emit substantial spurious radiation. (In this regard, it should be noted that such spurious radiation from the feed pin can be expected to increase as the radiator patch is disposed at relatively higher distances above the ground plane 10.)

Even though the feedpoint 18 is located substantially at the center of the radiator patch 12, a matched impedance point is nevertheless forced to coexist at that location by providing a impedance matching slot 20 along the zero potential boundary (center line 22) of the dual slotted microstrip radiator structure. The width of the impedance matching slot 20 is typically as narrow as practical (e.g. 0.01 to 0.03 inch or so) while the length is controlled (e.g. somewhat less than one-half wavelength) so as to achieve a matched r.f. impedance at the feedpoint 18 with respect to the anticipated feedline structure. That is, the r.f. impedance at feedpoint 18 can be expected to increase as the length dimension of slot 20 is increased for some range as depicted in FIG. 4. Accordingly, by suitably increasing the length of slot 20, a matched r.f. impedance condition can be achieved at feedpoint 18. As with the selection of matched feedpoint locations in the prior art, a certain amount of trial and error procedure may have to be followed so as to achieve optimum matched feedpoint conditions for a particular antenna application, dimensions, etc.

Typically, the total perimeter of the slot will be slightly less than one wavelength (i.e. slot length slightly less than one-half wavelength) so as to achieve a 180° phase shift from one side of the slot (i.e. near the feedpoint) to the opposite side (i.e. opposite the feedpoint) and the desired r.f. impedance match.

Actual radio frequency feedline connections to feedpoint 18 can be made using conventional techniques. For example, the structure may be fed by a feed 10 emanating through the resonant cavity from the center conductor of an r.f. connector whose outer conductor is electrically common to the ground plane as shown in FIG. 2. The structure may also be fed by a coaxial r.f. transmisson line having its center conductor connected to the feedpoint and its outer conductor connected to the ground plane and possibly also to the opposite side of the impedance matching slot as depicted in FIG. 3. It is also typical to utilize honeycomb shaped expanded dielectric structures as part of the dielectric spacing structure.

The shaped radiator patch and impedance-matching slot may be formed by selective photochemical etching (e.g. as used in production of printed circuit boards) of a conductive sheet bonded to one side of a dielectric sheet. The other side of the dielectric sheet is typically bonded to the ground or reference plane surface. It is also typical to utilize honeycomb shaped expanded dielectric structures as part of the dielectric spacing structure.

Specific dimensions of one operative exemplary embodiment of this invention are provided below:

| | |
|---|---|
| feed probe impedance = | 50 ohms |
| operating frequency = | 3.65 GHz |
| patch width = | 1.1 inch |
| patch length = | 1.7 inch |
| slot width = | .030 inch |
| element-to-ground plane spacing (expanded honeycomb dielectric) | 0125 inch |

As mentioned above, optimum impedance matching at the feedpoint can be achieved for a particular structure by simple trial and error procedure as should now be appreciated by those skilled in the art. However, one general guideline or rule of thumb that may be used for defining the approximate desired length of the impedance matching slot is that its total perimeter is slightly less than one wavelength (e.g. about 91% of one wavelength for a 50 ohm feedpoint). The impedance matching slot does not have to be in a linear or straight line configuration. It may be curvilinear or made up of discrete segments of lines, curves, etc. However, it is preferred to pass substantially adjacent the desired feedpoint location.

While only a few exemplary embodiments of this invention have been described in detail above, those skilled in the art will recognize that there are many possible variations and modifications that may be made in the exemplary embodiments while still retaining many of the novel features and advantages of this invention. Accordingly, all such variations and modifications are intended to be included within the scope of the following appended claims.

What is claimed is:

1. A radio frequency antenna structure comprising a symmetrically fed dual-slotted half-wavelength microstrip radiator patch and including:

a linearly polarized radiator patch having a resonant half-wavelength dimension along its direction of linear polarization and a low impedance centerline transverse to said resonant dimension, said patch being disposed above a reference surface and defining a resonant cavity with a pair of spaced-apart radiating slots or apertures therebetween;

an r.f. feedpoint connection disposed substantially within said radiator patch; and an impedance matching slot having an entirely closed boundary perimeter of less than one wavelength formed within said radiator patch substantially along said low impedance centerline transverse to said resonant dimension and also having predetermined location and dimensions for producing a corresponding predetermined r.f. impedance at said r.f. feedpoint connection.

2. A symmetrically fed dual-slotted half wavelength microstrip antenna structure comprising:

a conductive ground or reference surface;

a conductive dual radiating slot half wavelength radiator patch disposed above said reference surface;

an impedance matching slot formed in said patch at approximately the center thereof and having a closed perimeter of less than one wavelength for providing a predetermined r.f. impedance substantially greater than zero impedance at said feedpoint; and wherein said impedance matching slot is substantially parallel to the dual radiating slots formed by opposing edges of the patch and the underlying reference surface and also transverse to a one-half wavelength resonant dimension of said patch.

3. A symmetrically fed dual-slotted half wavelength microstrip radio frequency radiator patch antenna structure comprising:

a conductive ground or reference surface;

a conductive patch disposed above said reference surface and thereby defining a resonant cavity in the volume included therebetween with one resonant dimension of the cavity being approximately one-half wavelength long at an intended antenna operating frequency and also defining a pair of radiating slots or apertures between opposing edges of said patch and the underlying reference surface with said radiating apertures each being oriented substantially transverse to said resonant dimension;

at least one r.f. feedpoint connection disposed on said patch substantially midway between said radiating apertures; and said patch including a slot formed therein and disposed at the patch mid portion substantially adjacent said feedpoint connection, said slot extending substantially transverse to said resonant dimension for a predetermined distance thereby providing a corresponding predetermined r.f. impedance at said feedpoint connection.

4. A radio frequency antenna structure as in claim 3 including r.f. feed means having one feed conductor electrically connected to said feedpoint on said patch and another feed conductor electrically connected to said reference surface.

5. A symmetrically fed dual-slotted half-wavelength microstrip radio frequency radiator patch antenna structure comprising:

a conductive ground or reference surface;

a conductive path disposed above said reference surface and thereby defining a resonant cavity in the volume included therebetween with one resonant dimension of the cavity being approximately one-half wavelength long at an intended antenna operating frequency and also defining a pair of radiating slots or apertures between opposing edges of said patch and the underlying reference surface with said radiating apertures each being oriented substantially transverse to said resonant dimension;

at least one r.f. feedpoint connection disposed on said patch substantially midway between said radiating apertures;

said patch including a slot formed therein and disposed at the patch mid portion substantially adjacent said feedpoint connection, said slot extending substantially transverse to said resonant dimension for a predetermined distance thereby providing a corresponding predetermined r.f. impedance at said feedpoint connection; and r.f. feed means having one feed conductor electrically connected to said feedpoint on said patch and another feed conductor electrically connected to said reference surface;

wherein said another feed conductor is electrically connected to said patch at at least one reference point disposed on the opposite side of said slot from said feedpoint connection.

6. A symmetrically fed dual-slotted half-wavelength microstrip radio frequency radiator patch antenna structure comprising:

a conductive ground or reference surface;

a conductive patch disposed above said reference surface and thereby defining a resonant cavity in the volume included therebetween with one resonant dimension of the cavity being approximately one-half wavelength long at an intended antenna operating frequency and also defining a pair of radiating apertures between opposing edges of said patch and the underlying reference surface with said radiating apertures each being oriented substantially transverse to said resonant dimension;

at least one r.f. feedpoint connection disposed on said patch substantially midway between said radiating apertures; and said patch including a slot formed therein and disposed at the patch mid portion substantially adjacent said feedpoint connection, said slot extending substantially transverse to said resonant dimension for a predetermined distance thereby providing a corresponding predetermined r.f. impedance at said feedpoint connection;

wherein said patch is substantially rectilinear in shape and wherein said radiating apertures and said slot are each of substantially straight line linear shapes.

7. A radio frequency antenna structure as in claim 6 wherein said patch is of substantially rectangular shape having a width dimension approximately equal to one-half wavelength at an intended operating frequency and having a length dimension less than one wavelength at said operating frequency.

8. A radio frequency antenna structure as in claim 7 wherein said slot is of substantially rectangular shape having a perimeter slightly different from one wavelength at said operating frequency.

9. A radio frequency antenna structure as in claim 8 wherein said slot has a closed boundary wholly contained within the outer patch boundaries.

10. A method of obtaining matched impedance feeding of a symmetrically fed dual-slotted linearly polarized half-wavelength microstrip radio frequency radiator patch antenna structure having a conductive ground or reference surface, a conductive radiator patch disposed above said reference surface and defining a resonant cavity with a pair of spaced-apart radiating slots or apertures therebetween and an r.f. feedpoint connection disposed substantially within said radiator patch, said method comprising the step of:

forming an impedance matching slot having an entirely closed boundary perimeter of less than one wavelength within said radiator patch and substantially transverse to the resonant dimension of said linearly polarized antenna structure and also having predetermined location and dimensions for producing a corresponding predetermined r.f. impedance at said r.f. feedpoint connection.

11. A method of obtaining matched impedance feeding of symmetrically fed dual-slotted half-wavelength microstrip radiator patch antenna structure having a conductive ground or reference surface, and a conductive dual raidating slot half wavelength radiator patch disposed above said reference surface, said method comprising the steps of:

forming an impedance matching slot in said patch at approximately the center thereof having a closed perimeter of less than one wavelength for providing a predetermined r.f. impedance substantially greater than zero impedance at said feedpoint; and wherein said impedance matching slot is formed substantially parallel to the dual radiating slots defined by opposing edges of the patch and the underlying referecne surface and also formed transverse to a one-half wavelength resonant dimension of said patch.

* * * * *